US010094192B2

(12) United States Patent
Ford et al.

(10) Patent No.: US 10,094,192 B2
(45) Date of Patent: Oct. 9, 2018

(54) WICKERS WITH TRAPPED FLUID RECESSES FOR WELLHEAD ASSEMBLY

(71) Applicant: Vetco Gray Inc., Houston, TX (US)

(72) Inventors: David L. Ford, Houston, TX (US); Guaraci Bornia, Sao Paulo (BR); Hugo Lopes, Sao Paulo (BR); Ricardo Silva, Jandria (BR)

(73) Assignee: Vetco Gray, LLC, Houston, TX (US)

( * ) Notice: Subject to any disclaimer, the term of this patent is extended or adjusted under 35 U.S.C. 154(b) by 96 days.

(21) Appl. No.: 15/196,940

(22) Filed: Jun. 29, 2016

(65) Prior Publication Data

US 2018/0002998 A1 Jan. 4, 2018

(51) Int. Cl.
*E21B 33/04* (2006.01)

(52) U.S. Cl.
CPC ..... *E21B 33/04* (2013.01); *E21B 33/0422* (2013.01)

(58) Field of Classification Search
CPC ..... E21B 33/04; E21B 33/0422
USPC ..... 166/379
See application file for complete search history.

(56) References Cited

U.S. PATENT DOCUMENTS 4,742,874 A 5/1988 Gullion
9,169,711 B2 10/2015 Raynal et al.
2014/0096977 A1* 4/2014 Gette ..... E21B 33/03 166/379
2014/0131054 A1* 5/2014 Raynal ..... E21B 33/03 166/387
2015/0114622 A1 4/2015 Gadre et al.
2016/0145960 A1 5/2016 Gadre et al.

FOREIGN PATENT DOCUMENTS

WO 2016/049300 A1 3/2016

OTHER PUBLICATIONS

J. Pallini, et al., U.S. Appl. No. 15/087,421, Wellhead Metal Seal and Energizing Ring Having Trapped Fluid Reliefs, filed Mar. 31, 2016.
International Search Report and Written Opinion issued in connection with corresponding PCT Application No. PCT/US17/39902 dated Aug. 25, 2017.

* cited by examiner

*Primary Examiner* — Taras P Bemko
(74) *Attorney, Agent, or Firm* — Hogan Lovells US LLP

(57) ABSTRACT

A wellhead assembly includes a wellhead housing having a bore with a wellhead housing sidewall and a longitudinal axis. A hanger lands in the bore, the hanger having a hanger sidewall. Parallel circumferentially extending hanger sidewall ridges are located on the hanger sidewall. Each of the hanger sidewall ridges have upper and lower flanks that converge to a crest. Hanger sidewall bands are located between adjacent ones of the hanger sidewall ridges. A metal seal ring has an outer seal surface in metal-to-metal sealing engagement with the wellhead housing sidewall and an inner seal surface in metal-to-metal sealing engagement with the hanger sidewall bands. Crests of the hanger sidewall ridges embed into the inner seal surface to restrict relative movement between the hanger and the seal ring. A recess extends through each of the hanger sidewall ridges from the upper flank to the lower flank to allow any fluid trapped between the hanger sidewall ridges to flow out.

17 Claims, 5 Drawing Sheets

WICKERS WITH TRAPPED FLUID RECESSES FOR WELLHEAD ASSEMBLY

FIELD OF THE DISCLOSURE

This disclosure relates in general to subsea wellhead assemblies, and in particular to a hanger metal-to-metal seal bands located between non-sealing wickers having recesses to avoid trapped liquids between the wickers.

BACKGROUND

One type of subsea well has a wellhead housing at the sea floor. One or more casing hangers land in the bore of the wellhead housing, each secured to an upper end of a string of casing. After cementing the casing, a running tool sets a packoff or annulus seal between the casing hanger and the wellhead housing.

One type of packoff has a metal ring with inner and outer legs separated by an annular slot. The running tool pushes an energizing ring into the slot, which radially deforms the inner and outer legs into sealing engagement with the wellhead housing and the casing hanger.

One or both of the seal surfaces in the wellhead housing and on the casing hanger may have a set of wickers. The wickers are parallel grooves, each having a sharp crest. The sharp crests of the wickers embed into the seal ring surface when set with the energizing ring. The embedded wickers form seals as well as resisting axial movement of the seal assembly relative to the wellhead and casing hanger.

The wellhead housing will be filled with a liquid, which may be drilling fluid, before the seal ring sets. When the seal ring wall moves radially into engagement with the wickers, some of the liquid may be trapped in the wickers, forming a hydraulic lock. The trapped liquid can result in high pressure build up in the wickers, which restricts the depth that the wickers embed into the seal ring. The lesser depth or engagement can reduce the effectiveness of the seal ring.

SUMMARY

A wellhead assembly includes a wellhead housing having a bore with a wellhead housing sidewall and a longitudinal axis. A hanger lands in the bore, the hanger having a hanger sidewall. Parallel circumferentially extending ridges are located on at least one of the sidewalls, each of the ridges having upper and lower flanks that join a crest. A sealing band is located between adjacent ones of the ridges. A metal seal ring has inward facing and outward facing seal surfaces in metal-to-metal sealing engagement with the hanger and wellhead housing sidewalls, respectively. At least one of the seal surfaces is in metal-to-metal sealing engagement with the bands. The crests of the ridges embed into said at least one of the seal surfaces. A recess extends through each of the ridges from the upper flank to the lower flank to allow any fluid trapped between the ridges to flow out.

An axial dimension of each of the bands is greater than a distance from a base of the upper flank to a base of the lower flank of each of the ridges. An axial dimension of each of the bands is greater than a radial protrusion dimension of each of the ridges. In one embodiment, each of the bands is cylindrical. An axial distance from a center of the crest of one of the ridges to a center of the crest of an adjacent one of the ridges is greater than a radial protrusion of each of the ridges past the bands.

Each of the recesses has a base that is recessed from adjacent ones of the bands. In some of the embodiments, each of the recesses has a circumferential dimension greater than an axial dimension. In one of the embodiments, a chamfer is formed at an upper junction between each of the recesses and a next upper one of the bands. Another chamfer is formed at a lower junction between each of the recesses and a next lower one of the bands. In one of the embodiments, each of the recesses is circular. An axial cross section of each of the ridges may define an equilateral triangular configuration.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
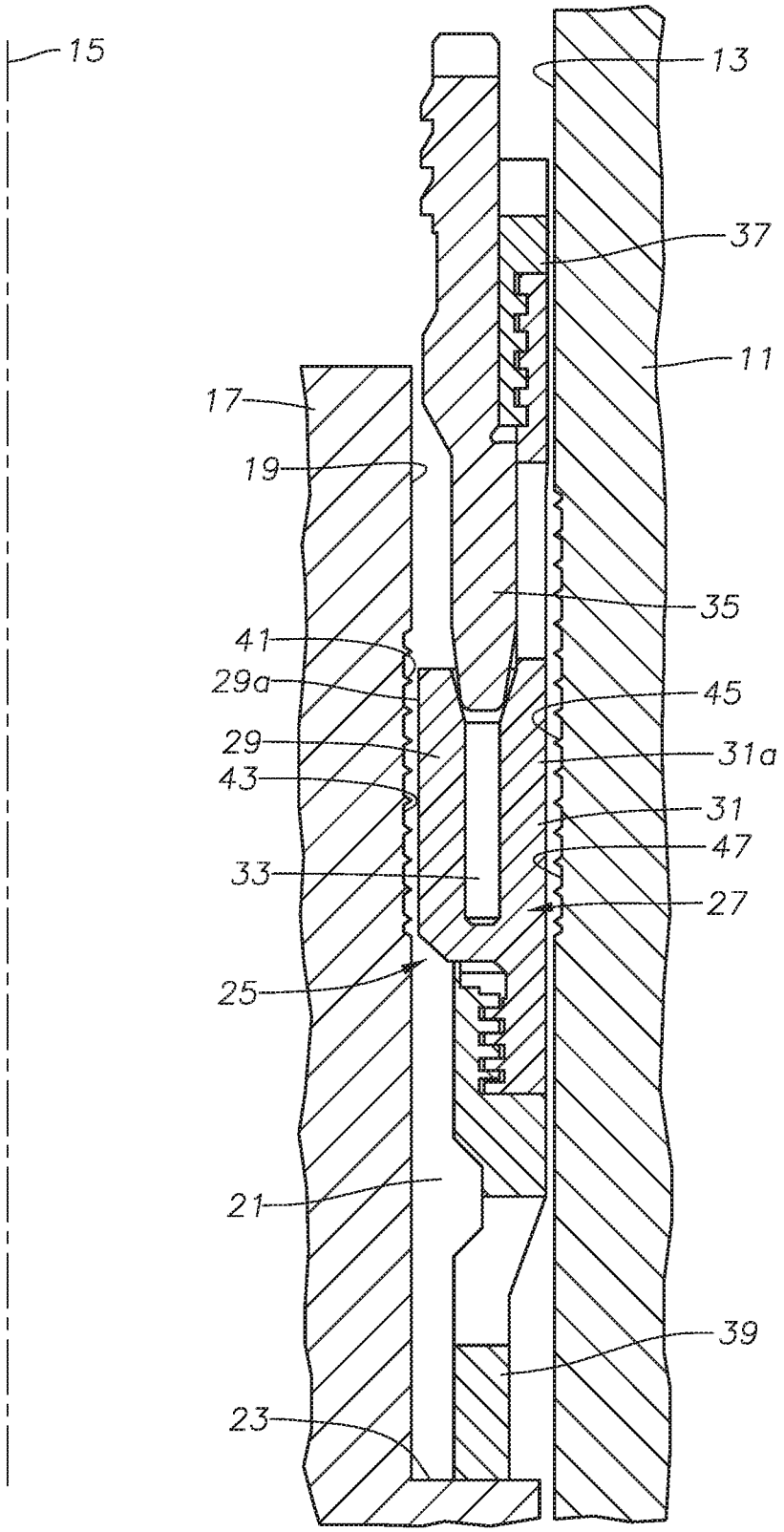
FIG. 1 is a quarter sectional view of a portion of a seal arrangement between a casing hanger and a wellhead housing, with the seal ring assembly shown prior to setting.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a subsea wellhead assembly includes a wellhead housing 11, which is a large cylindrical member. Wellhead housing 11 has a bore defined by an inward facing or inner cylindrical sidewall 13 and a longitudinal axis 15. FIG. 1 shows a casing hanger 17 landed in wellhead housing 11. A string of casing (not shown) secures to a lower end of casing hanger 17 and is cemented within the well. Other types of hangers, such as a bridging hanger, which does not support a string of pipe, could be located in wellhead housing 11. Casing hanger 17 has an outward facing or outer sidewall 19 that is spaced radially inward from wellhead housing sidewall 13, defining an annulus seal pocket 21. Casing hanger 17 has an external upward facing shoulder 23 that defines a lower end of seal pocket 21.

An annulus seal assembly 25 locates in seal pocket 21 and seals the annulus between casing hanger 17 and wellhead housing 11 after the casing has been cemented. Seal assembly 25 may be a variety of types of metal-to-metal seals. In this example, seal assembly 25 has a seal ring 27 that encircles casing hanger 17. Seal ring 27 has an inner leg 29 and an outer leg 31 that are cylindrical and radially spaced apart by an annular slot 33. When it is time to set seal assembly 25, a running tool (not shown) will push an energizing ring 35 down into slot 33. Energizing ring 35 has a greater radial thickness than the radial dimension of slot 33, causing inner and outer legs 29, 31 to move radially apart. Inner leg 29 has a smooth cylindrical inward facing seal surface 29*a* that forms a metal-to-metal seal against a sealing surface on casing hanger sidewall 23. Outer leg 31 has a smooth cylindrical outward facing seal surface 31*a* that forms a metal-to-metal seal against a sealing surface on wellhead housing sidewall 13. The deformation of seal ring 27 is permanent, exceeding the yield strength of the metal of seal ring 27.

One of the legs 29, 31, and in this example, outer leg 31, extends higher than inner leg 29. A retainer ring 37 secures by threads to the upper end of outer leg 31 to retain energizing ring 35 with seal ring 27 during run-in. A lower extension 39 secures to the lower end of seal ring 27 and abuts casing hanger external shoulder 23.

In this embodiment, the seal surface of casing hanger sidewall 19 includes a set of outward facing wickers 41 separated by sealing bands 43. Wickers 41 are parallel ridges or ribs extending circumferentially around casing hanger 17 in planes perpendicular to axis 15. In this embodiment, sealing bands 43 are smooth, cylindrical surfaces extending completely around casing hanger sidewall 19 without interruption. Wickers 41 do not seal to casing hanger inner leg seal surface 29*a*, rather they serve as a lockdown feature to restrict axial movement of seal ring 27 and casing hanger 17 relative to each other after setting. The hardness of casing hanger sidewall 19 is greater than the hardness of seal ring inner leg seal surface 29*a*. During setting, the harder wickers 41 will bite into or embed in the softer inward facing seal surface 29*a* of inner leg 29. The metal-to-metal sealing occurs between seal bands 43 and inner leg seal surface 29*a*. As an example, the yield strength of seal ring 27 may be 33 ksi (thousand pounds per square inch), and the yield strength of casing hanger sidewall 19 may be 60 ksi.

In FIG. 1, wellhead housing sidewall 13 also has a set of lockdown, non-sealing wickers 45 separated by sealing bands 47. Wellhead housing wickers 45 are also parallel lockdown ridges that may be identical to casing hanger wickers 41. Wellhead housing wickers 45 do not seal to casing hanger outer leg seal surface 31*a*, rather they serve to restrict axial movement of seal assembly 25 relative to wellhead housing 11 after setting. Wellhead housing sidewall 13 is also of harder metal than casing hanger outer seal surface 31*a*. During setting, wellhead housing wickers 45 will bite into or embed in the outward facing seal surface 31*a* of outer leg 31. Metal-to-metal sealing occurs between wellhead housing seal bands 47 and outer leg seal surface 31*a*.

The lower ends of the both arrays of wickers 41, 45 may be approximately at the lower end of or below inner leg 29. The upper end of the array of casing hanger wickers 41 may be above inner leg 29 to allow some variation in where seal assembly 25 locates relative to casing hanger 17. Optionally, the upper end of the array of wellhead housing wickers 45 is above the upper end of casing hanger wickers 41 because outer leg 31 extends above inner leg 29. The number of casing hanger wickers 41 and wellhead housing wickers 45 can vary. In one example, casing hanger 17 has eleven casing hanger wickers 41 and wellhead housing 11 has twenty wellhead housing wickers 45.

Optionally, one of the sets of wickers 41, 45 could be eliminated. For example, wellhead housing sidewall 13 could be free of wickers 45 and have instead a smooth cylindrical surface. A separate lockdown arrangement (not shown) could be used to lockdown casing hanger 17 and seal assembly 25 relative to wellhead housing 11.

Figure 2:
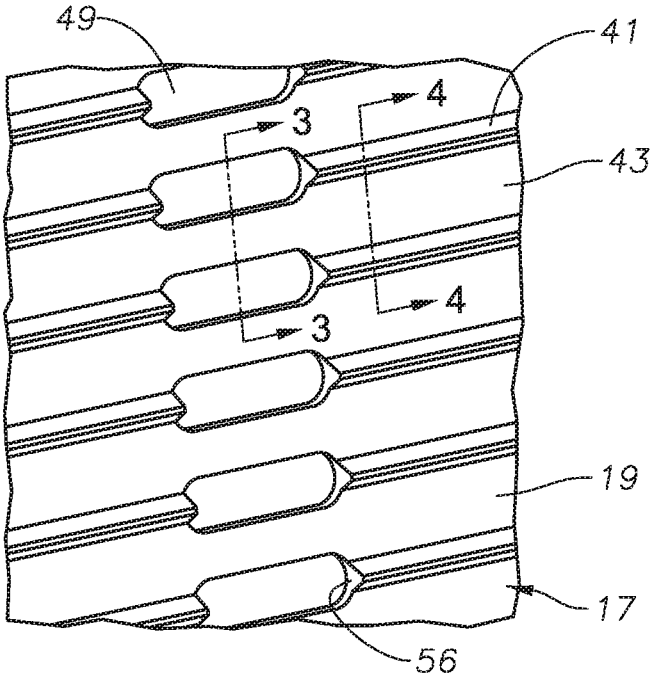
FIG. 2 is perspective view of part of the wickers on the casing hanger of FIG. 1.

Casing hanger wickers 41 do not extend 360 degrees without interruption. Referring to FIG. 2, channels, slots, or recesses 49 prevent casing hanger wickers 41 from sealing with casing hanger inner leg seal surface 29*a* (FIG. 1). Wellhead housing wickers 45 also have recesses that prevent them from sealing with casing hanger outer leg seal surface 31*a*. The recesses of wellhead housing wickers 45 are not separately described as they may be identical to and function the same as casing hanger wicker recesses 49. Recesses 49 are illustrated one directly above the other, defining an axial flow path from below to above the set of casing hanger wickers 41. However, recesses 49 in the separate wickers 41 could be rotationally staggered relative to each other. Also, although FIG. 2 shows only a single recess 49 for each wicker 41, each wicker 41 may have several recesses 49 circumferentially spaced apart from each other.

Casing hanger recesses 49 relieve liquid that might otherwise be trapped between casing hanger wickers 41 during setting. Normally, wellhead housing 11 will be filled with liquid, such as drilling mud or water, prior to setting seal assembly 25. As seal ring inner leg seal surface 29*a* moves radially into sealing engagement with casing hanger seal bands 43, liquid otherwise trapped between inner leg seal surface 29*a* and seal bands 43 can flow upward and downward from the set of casing hanger wickers 41. Allowing the liquid to flow from the spaces between wickers 41 reduces the chance of hydraulic lock from occurring.

Figure 3:
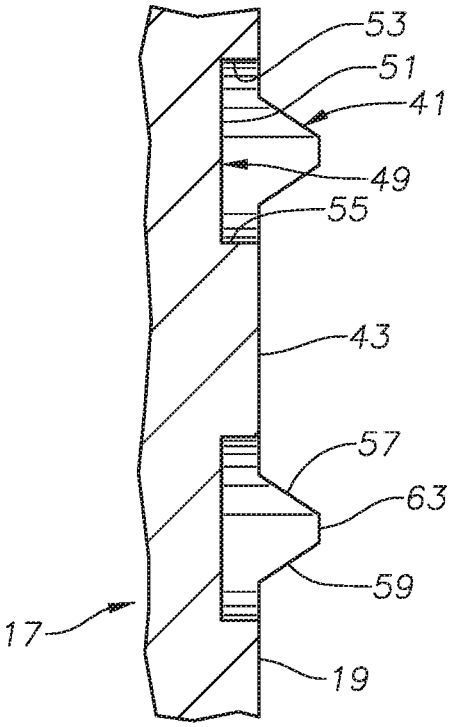
FIG. 3 is a sectional view of the wickers of FIG. 2 taken along the line 3-3 of FIG. 2.
Figure 4:
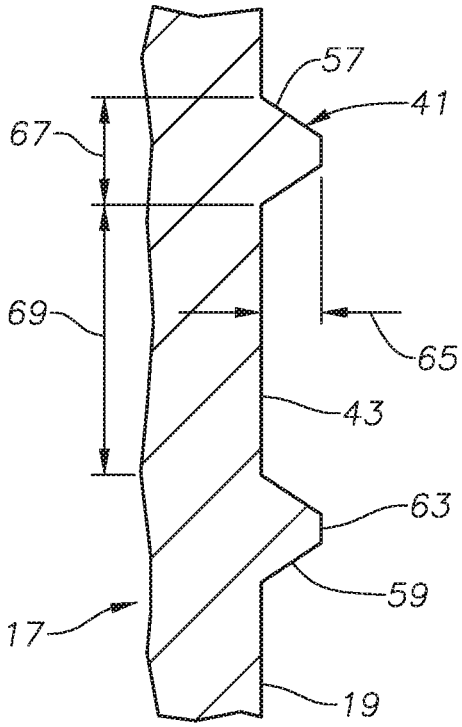
FIG. 4 is a sectional view of the wickers of FIG. 2 taken along the line 4-4 of FIG. 3.
Figure 5:
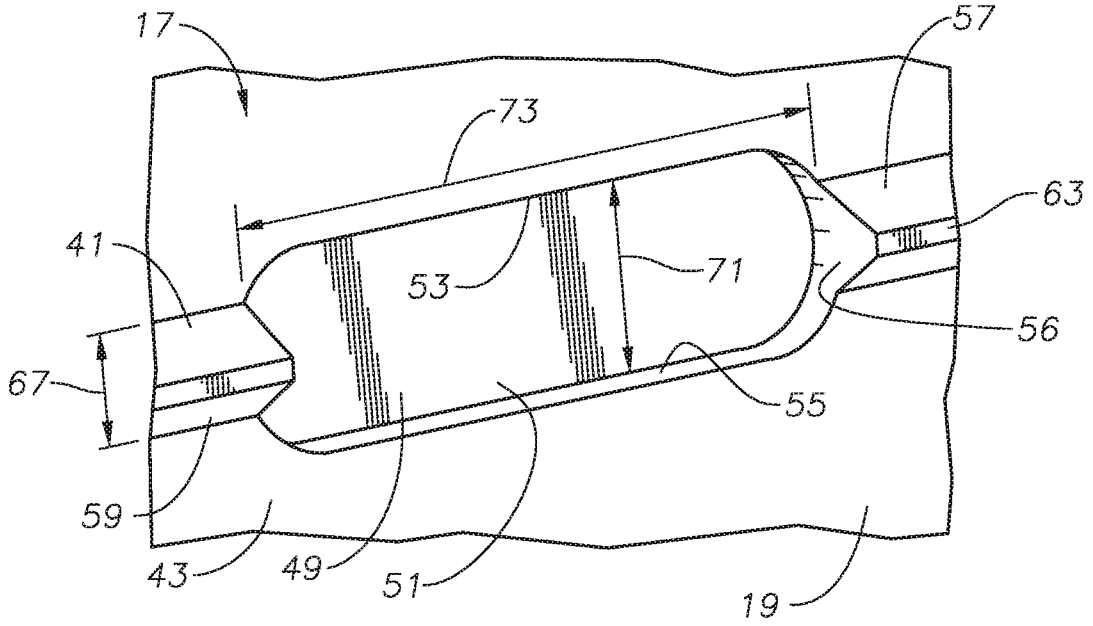
FIG. 5 is an enlarged perspective view of a slot located in one of the wickers of FIG. 2.

Recesses 49 may have a variety of configurations. In FIG. 3-5, each recess 49 has a base 51 facing outward relative to axis 15 (FIG. 1). Recess base 51 may be a segment of a cylindrical surface, as shown, or other shapes, such as slightly concave or convex. In this embodiment, recess base 51 is recessed from seal bands 43; that is the radial distance from axis 15 (FIG. 1) to recess base 51 is slightly less than the radial distance from axis 15 to seal band 43. Stated other way, the outer diameter of seal bands 43 is slightly greater than the outer diameter of recesses 49. Consequently, when inner leg seal surface 29*a* (FIG. 1) is deformed against seal bands 43, a slight gap will exist between inner leg seal surface 29*a* and recess base 51 to allow liquid to flow out. The gap will equal the depth of recess base 51.

In the example of FIGS. 2-5, recess 49 has an upper wall or edge 53 and a lower wall or edge 55. Upper and lower walls 53, 55 are parallel with each other and with wickers 41 in this example. Upper and lower walls 53, 55 extend circumferentially a selected distance and have circumferentially spaced apart ends 56 that join upper and lower walls 3, 55 and may be curved, as shown.

Referring to FIG. 4, each wicker 41 has a conical upper flank 57 and a conical lower flank 59 that converge toward each other, joining a crest 63. Crest 63 is shown to be blunted, having a cylindrical shape, but it could be sharper. The cross-sectional shape of the wicker 41 shown is that of an equilateral triangle, but it may have other shapes. Wickers 41 protrude radially outward past sealing bands 43 a distance 65 that may be varied. In one example, distance 65 is about 0.020 inch. Protrusion distance 65 is shown to be about double the depth of each recess 49 (FIG. 3), but that can also vary. The axial dimension or width 69 of each sealing band 43 is considerably greater, more than double, than the axial dimension 67 of each wicker 41. Axial dimension 67 is measured from the base or junction of upper flank 57 and the next upward sealing band 43 to the junction of lower flank 59 and the next lower sealing band 43. Stated another way, a distance between midpoints of crests 63 of adjacent wickers 41 is considerably greater than the axial dimension 67 of each wicker 41.

Referring to FIG. 5, an axial dimension 71 of each recess 49 is greater than axial dimension 67 of each wicker 41. A circumferential length 73 of recess 49 may vary, and in this example, it is greater than wicker axial dimension 67. Recess circumferential length 73 is much less than 360 degrees about axis 15 (FIG. 1).

Figure 6:
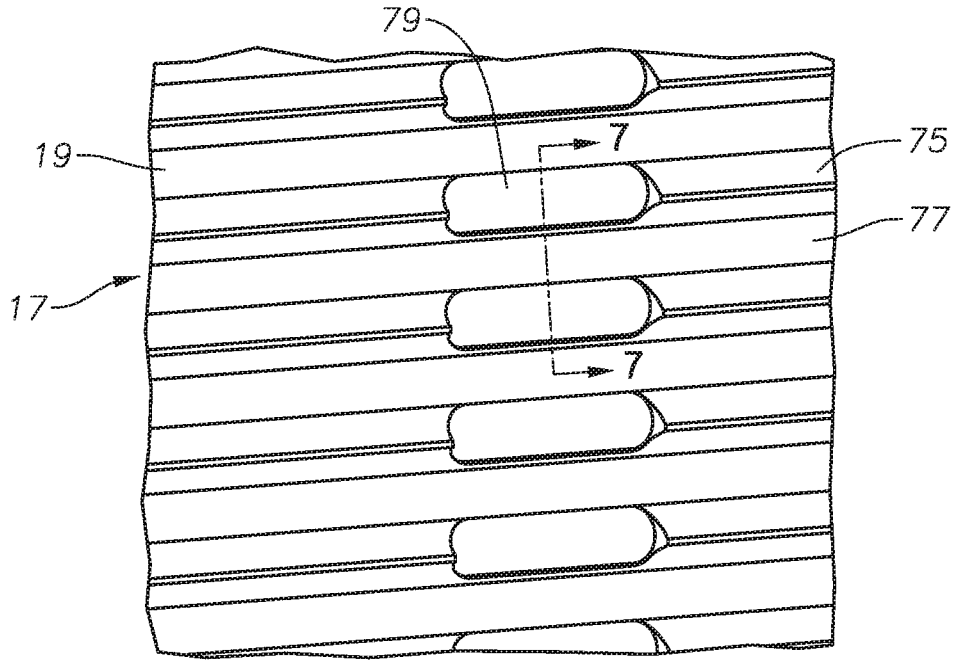
FIG. 6 is partial perspective view of an alternate embodiment of the wickers of FIG. 2.
Figure 8:
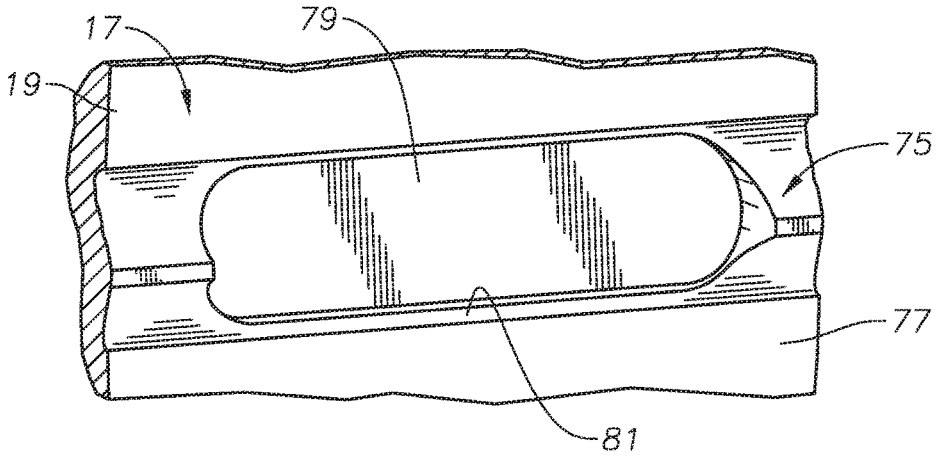
FIG. 8 is an enlarged perspective view of a recess located in one of the wickers of FIG. 6.
Figure 7:
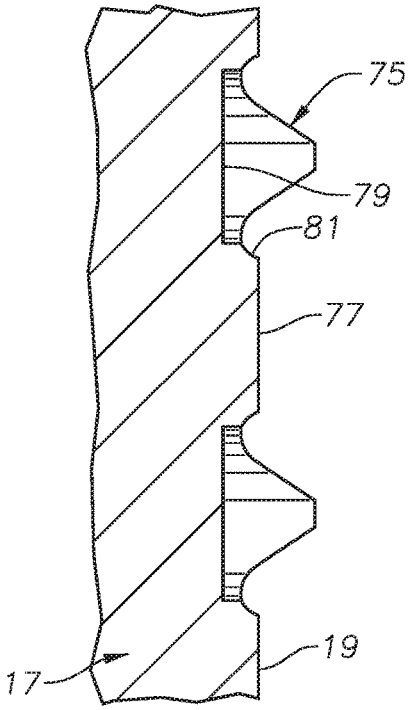
FIG. 7 is a sectional view of the wickers of FIG. 6 taken along the line 7-7 of FIG. 6.

Referring to FIGS. 6-8, in this alternate embodiment, wickers 75, bands 77 and recesses 79 are shown as having the same general configuration as in FIGS. 2-5. Seal bands 77 differ only in that a bevel or chamfer 81 is formed on the upper and lower edges of each seal band 77. Chamfer 81 is a conical surface, which is illustrated as curved, but could be flat. One chamfer 81 is located at a junction between the lower wall of recess 79 and the next lower sealing band 77. The other chamfer 81 is located at a junction between the upper wall of recess 79 and the next upward sealing band 77.

Figure 9:
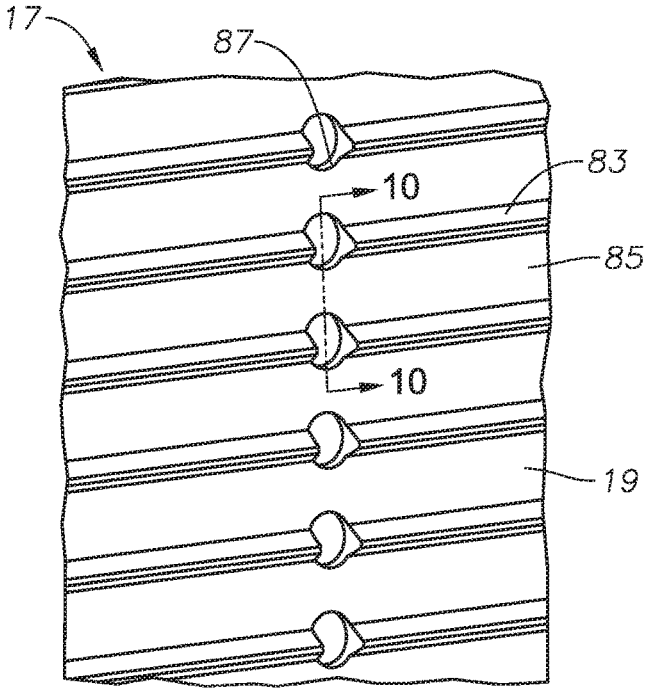
FIG. 9 is a partial perspective view of another alternate embodiment of the wickers of FIG. 2.
Figure 10:
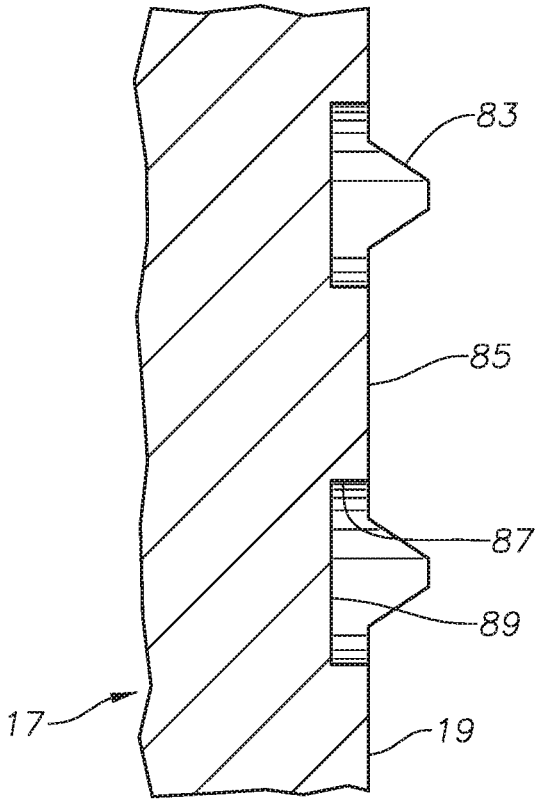
FIG. 10 is a sectional view of the wickers of FIG. 9 taken along the line 10-10 of FIG. 9.
Figure 11:
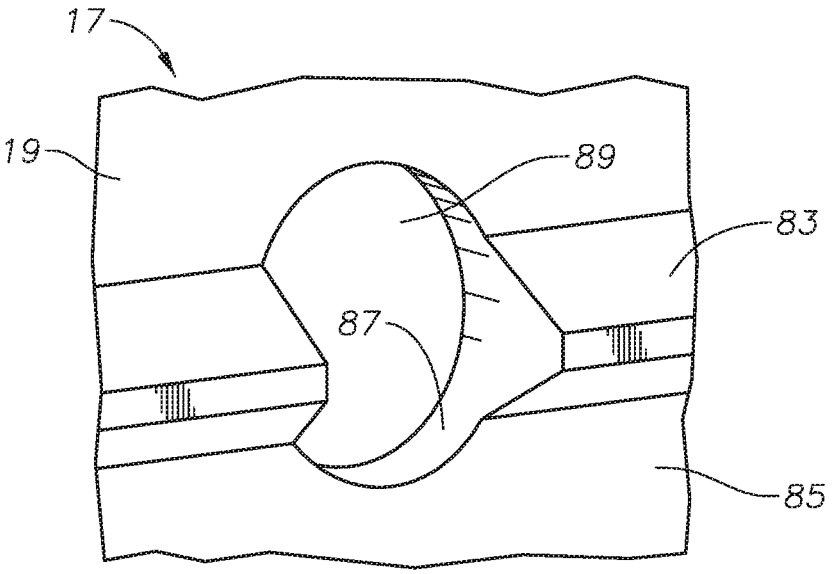
FIG. 11 is an enlarged perspective view of a slot located in one of the wickers of FIG. 9.

Referring to FIGS. 9-11, in this additional alternate embodiment, wickers 83 and bands 85 may be the same general configuration as in the other embodiments. However, recesses 87 are not generally rectangular as in the other embodiments. Instead, each recess 87 has a base 89 with a circular circumference. The diameter of base 89 is greater than the axial dimension of each wicker 83 in this example.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The invention claimed is:

1. A wellhead assembly, comprising:

a wellhead housing having a bore with a wellhead housing sidewall and a longitudinal axis;

a hanger landed in the bore, the hanger having a hanger sidewall;

a plurality of parallel circumferentially extending ridges located on at least one of the sidewalls, each of the ridges having upper and lower flanks that join a crest;

a plurality of sealing bands, each of the bands being located between adjacent ones of the ridges;

a metal seal ring having inward facing and outward facing seal surfaces in metal-to-metal sealing engagement with the hanger and wellhead housing sidewalls, respectively;

at least one of the seal surfaces being in metal-to-metal sealing engagement with the bands;

the crests of the ridges being embedded into said at least one of the seal surfaces; and a recess extending through each of the ridges from the upper flank to the lower flank, the recess having a surface recessed from adjacent bands, wherein a gap exists between a least a portion of the surface of the recess and the at least one of the seal surfaces to allow fluid trapped between the ridges to flow out.

2. The assembly according to claim 1, wherein an axial dimension of each of the bands is greater than a distance from a base of the upper flank to a base of the lower flank of each of the ridges.

3. The assembly according to claim 1, wherein an axial dimension of each of the bands is greater than a radial protrusion dimension of each of the ridges.

4. The assembly according to claim 1, wherein each of the bands is cylindrical.

5. The assembly according to claim 1, wherein an axial distance from a center of the crest of one of the ridges to a center of the crest of an adjacent one of the ridges is greater than a radial protrusion of each of the ridges past the bands.

6. The assembly according to claim 1, further comprising:

an upper junction between the recess and a next upper one of the bands;

a lower junction of the recess and a next lower one of the bands; and wherein each of the junctions comprises a chamfer.

7. The assembly according to claim 1, wherein the recess is circular.

8. The assembly according to claim 1, wherein an axial cross section of each of the ridges defines an equilateral triangular configuration.

9. A wellhead assembly, comprising:

a wellhead housing having a bore with a wellhead housing sidewall and a longitudinal axis;

a hanger landed in the bore, the hanger having a hanger sidewall;

a plurality of parallel circumferentially extending hanger sidewall ridges located on the hanger sidewall, each of the hanger sidewall ridges having upper and lower flanks that converge to a crest;

a plurality of hanger sidewall bands, each of the hanger sidewall bands being located between adjacent ones of the hanger sidewall ridges;

a metal seal ring having an outward facing seal surface in metal-to-metal sealing engagement with the wellhead housing sidewall and an inward facing seal surface in metal-to-metal sealing engagement with the hanger sidewall bands;

the crests of the hanger sidewall ridges being embedded into the inward facing seal surface to restrict relative movement between the hanger and the seal ring; and a recess extending through each of the hanger sidewall ridges from the upper flank to the lower flank, the recess having a surface recessed from adjacent hanger sidewall bands, wherein a gap exists between a least a portion of the surface of the recess and the inward facing seal surface to allow fluid trapped between the hanger sidewall ridges to flow out.

10. The assembly according to claim 9, further comprising:

a plurality of parallel circumferentially extending wellhead housing sidewall ridges located on the wellhead housing sidewall, each of the wellhead housing sidewall ridges having upper and lower flanks that converge to a crest;

a plurality of wellhead housing sidewall bands, each of the wellhead housing sidewall bands being located between adjacent ones of the wellhead housing sidewall ridges;

the crests of the wellhead housing sidewall ridges being embedded into the outward facing seal surface to restrict relative movement between the seal ring and the wellhead housing; and a recess extending through each of the wellhead housing sidewall ridges from the upper flank to the lower flank of each of the wellhead sidewall ridges to allow any fluid trapped between the wellhead sidewall ridges to flow out.

11. The assembly according to claim 9, wherein a radial dimension from the axis to the recess is less than a radial dimension from the axis to each of the bands.

12. The assembly according to claim 9, wherein an axial distance from a center of the crest of one of the ridges to a center of the crest of an adjacent one of the ridges is greater than an axial dimension of each of the ridges, measured from a junction of the upper flank with an upper one of the bands to a junction of the lower flank with a lower one of the bands.

13. The assembly according to claim 9, wherein each of the bands is cylindrical.

14. The assembly according to claim 9, wherein the recess has upper and lower edges that are parallel with each other and perpendicular to the axis.

15. A method for sealing between a hanger sidewall of a hanger and a wellhead housing sidewall of a bore of a wellhead assembly, comprising:

(a) providing a plurality of parallel circumferentially extending ridges on at least one of the sidewalls, each of the ridges having upper and lower flanks that converge to a crest, with a sealing band located between adjacent ones of the ridges and a recess extending through each of the ridges from the upper flank to the lower flank, the recess having a surface recessed from adjacent sealing bands;

(b) placing a metal seal ring having outward facing and inward facing seal surfaces between the wellhead housing sidewall and the hanger sidewall, respectively, and deforming the seal ring such that at least one of the seal surfaces is in metal-to-metal sealing engagement with the band, the crests of the ridges are embedded into said at least one of the seal surfaces and a gap is located between a least a portion of the surface of the recess and said one of the seal surfaces; and (c) forcing liquid trapped between each of the ridges through the recess while performing step (b).

16. The method according to claim 15, wherein step (a) comprises providing the band with a cylindrical configuration.

17. The method according to claim 15, wherein step (a) comprises providing the ridges and the band on both the wellhead housing sidewall and the hanger sidewall.

* * * * *